US006062050A

United States Patent [19]

Lion

[11] Patent Number: 6,062,050

[45] Date of Patent: May 16, 2000

[54] GOLF CLUB LOCKING DEVICE

[76] Inventor: Ronald K. Lion, 375 Summit Rd., Watsonville, Calif. 95076

[21] Appl. No.: 09/336,359

[22] Filed: Jun. 18, 1999

Related U.S. Application Data

[63] Continuation-in-part of application No. 09/123,832, Jul. 28, 1998, abandoned.

[51] Int. Cl.[7] ..... E05B 69/00; A63B 55/04

[52] U.S. Cl. ..... 70/58; 70/18; 206/315.3; 206/315.6

[58] Field of Search ..... 70/58, 57, 18, 70/19, 61; 206/315.3, 315.4, 315.6

[56] References Cited

U.S. PATENT DOCUMENTS

| | | | |
|---|---|---|---|
| D. 336,603 | 6/1993 | Penaflor . | |
| 1,717,959 | 6/1929 | Cauffman . | |
| 1,770,060 | 7/1930 | Barlow | 206/315.6 |
| 3,139,132 | 6/1964 | Shiller . | |
| 4,522,299 | 6/1985 | Clark et al. . | |
| 4,860,889 | 8/1989 | Lemieux et al. . | |
| 4,863,019 | 9/1989 | Lewis et al. | 70/19 |
| 5,004,100 | 4/1991 | Smith | 70/19 |
| 5,267,660 | 12/1993 | Kwon | 211/70.2 |
| 5,524,753 | 6/1996 | Murphy | 70/58 |
| 5,582,043 | 12/1996 | McCue et al. | 70/19 |
| 5,636,735 | 6/1997 | Stusek | 206/315.6 |
| 5,971,146 | 10/1999 | Jones | 206/315.3 |

FOREIGN PATENT DOCUMENTS 2646785 11/1990 France .

*Primary Examiner*—Darnell M. Boucher
*Attorney, Agent, or Firm*—Jeffrey A. Hall

[57] ABSTRACT

A golf club bag having a golf club locking assembly integral therewith is provided, comprising a golf club bag with an integral golf club locking assembly, the assembly including an upper housing element with a latch coupled to the upper housing element, and a single locking plate coupled to said slide latch constrained within guide tracks moveable between the upper and lower housing element. A key cylinder is communicatively linked to the locking plate and an elastic bumper for holding golf clubs within the assembly is secured to the locking plate. A cable locking plate for locking the assembly to any object is secured to the device, and a lower housing element is configured to be secured to the upper housing element.

6 Claims, 4 Drawing Sheets

GOLF CLUB LOCKING DEVICE

This application is a continuation-in-part of application application Ser. No. 09/123,832 filed on Jul. 28, 1998 now abandoned.

BACKGROUND OF THE INVENTION

1. Field of Invention

This invention relates to locking and holding devices for golf clubs, and more particularly to locking and holding devices for golf clubs in combination with a golf club bag.

2. Description of the Related Art

The protection of golf clubs from theft is a significant concern to golf players and golf club owners. As the cost of golf clubs and accessories rise it is not uncommon for a typical golfer to have a significant investment in the contents of his or her golf bag, including golf clubs, wedges, and fairway woods. It is also not uncommon for golfers to leave their bags unattended for significant periods of time while in the club house, locker room, restaurant, or when traveling.

Various golf bag protection devices have been proposed and implemented. Some for example, include two or more arms or fingers through which golf clubs protrude. The arms are closed at one end and then secured with a key or combination lock. Such devices are not integrally formed with the golf bag nor are such locks integral with the locking devices.

Another type of golf bag locking devices is seen, for example, in U.S. Pat. Nos. 5,524,753 issued to Thomas Murphy, Jun. 11, 1996 and 5,636,735 issued to Richard A Stusek, Jun. 10, 1997. Such devices use a set of plates having slots or apertures therein to hold golf clubs and a locking plate to lock the clubs to the golf bags. This type of golf bag security device is configured either as part of the bag or is fastened on to the bag by means of screws or fasteners. Once these locks are in place then clubs are fed through openings which decrease in dimension as the lock is operated thereby sandwiching or pinching the golf club within the opening. Such limitations are undoubtedly a reason such golf club security devices have not received widespread acceptance.

Accordingly, it is the primary object of this invention to provide a golf club bag with a golf club locking device integral therewith which provides docking stations that each golf club can snap or insert into. The individual docking stations hold the clubs by means of a rubber or elastic bumper that holds the clubs within a lock and also protects the shafts from any abrasion. Once the clubs have been inserted into these docking stations then the simple action of a slide latch moves a single locking plate across the opening of these docking stations closing off the opening and locking the clubs within the device. In contrast to prior golf club security devices, the present invention holds and secures a golf club while maintaining the size of the club docking stations, while prior devices have locked a golf club by decreasing the size of the openings into which the golf club is locked. Further, the present locking golf club bag and holder allows for the clubs to be organized within the bag. This allows for an "easy on/easy off" type of club holder that can be used during a round of play. In addition, the size and weight of the lock is such that it does not add significant weight to the locking golf bag configuration.

Additional objects and advantages of the invention will be set forth in the description which follows, and in part will be obvious from the description, or may be learned by practice of the invention. The objects and advantages of the invention may be realized and obtained by means of the instrumentality's and combinations particularly pointed out in the appended claims.

SUMMARY OF THE INVENTION

To achieve the foregoing objects, and in accordance with the purpose of the invention as embodied and broadly described herein, an integrated golf club lock and golf club bag is provided, comprising a golf club bag with a golf club locking assembly mounted therein. The locking assembly preferably includes an upper and lower housing. A slide latch operably coupled to the upper housing element and a locking plate operably secured to said slide latch may be provided. The golf club lock is mounted within the golf club bag and functionally integral therewith. A key cylinder is communicatively linked to the locking plate and an elastic bumper for holding golf clubs within the assembly is secured to the lower housing. A cable locking plate for locking the assembly is secured to a cable anchor plate and locking cable, and a lower housing element is configured to be adapted and secured to the upper housing element.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

Drawing Reference Numerals

| | |
|---|---|
| 1) | Upper Housing |
| 2) | Slide Latch |
| 3) | Cable |
| 4) | Anchor Pin Hole |
| 5) | Anchor Pin |
| 6) | Rubber Bumper |
| 7) | Locking Plate |
| 8) | Club Divider |
| 9) | Key Cylinder |
| 10) | Anchor Pin Locking Port |
| 11) | Golf Club Bag |
| 12) | Key Cylinder Hole |

-continued

| | |
|---|---|
| 13) | Lower Housing |
| 14) | Retaining Screw Hole |
| 15) | Retaining Screw |
| 16) | Cable Anchor |
| 17) | Locking Assembly |
| 18) | Golf Club Ports |
| 19) | Locking Plate Ports |
| 20) | Bumper Ports |
| 21) | Top Portion Of Golf Bag |
| 22) | Integrated Golf Club Lock and Golf Club Bag |
| 25) | Rivet Holes |
| 26) | Golf Tee Ports |
| 27) | Cable Hole |
| 28) | Locking Plate Guide Track |
| 29) | Slide Latch Guide Track |
| 30) | Key Cylinder Locking Paul |
| 32) | Guide Track Slots |

DESCRIPTION OF THE PREFERRED EMBODIMENTS

Reference will now be made in detail to the present preferred embodiments of the invention as illustrated in the accompanying drawings.

In accordance with the present invention, there is provided in a preferred embodiment of the invention an integrated golf club lock and golf club bag, comprising a golf club bag having a golf club locking assembly mounted therein, the golf club locking assembly preferably comprising an upper and lower housing element, a slide latch may be provided coupled to the upper housing element, and a locking plate coupled to said slide latch and constrained by means of guide tracks operably linked to said upper and lower housing elements. The golf club lock is mounted within the golf club bag and functionally integral therewith. A key cylinder is communicatively linked to the locking plate and an elastic bumper for holding golf clubs within the assembly is secured to a lower housing. A cable locking plate for locking the assembly is secured to a cable anchor and locking cable, and a lower housing element is configured to be adapted secured to the upper housing element.

Figure 1:
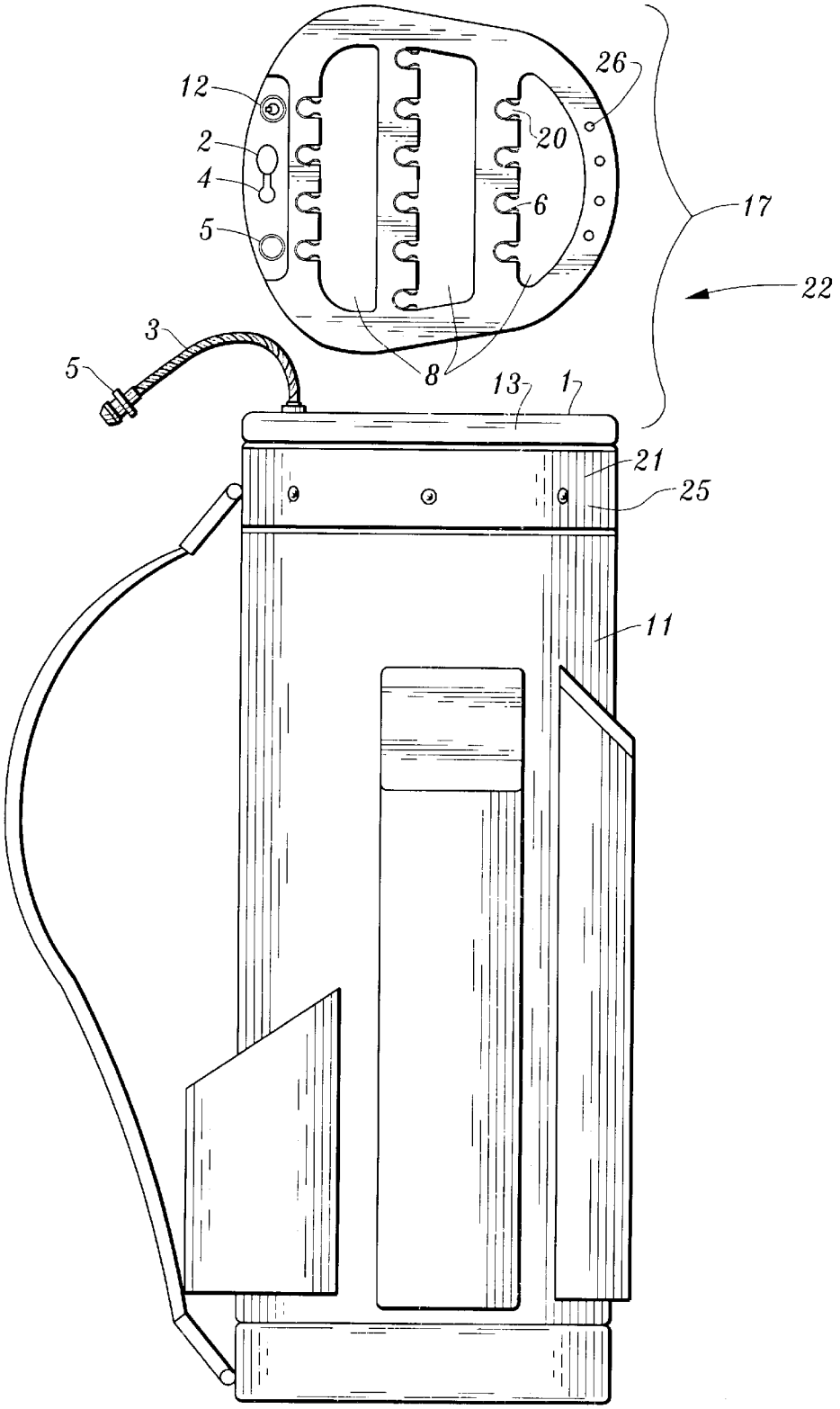
FIG. 1 is a side view and top view of the integrated golf club lock and golf club bag, according to the invention.
Figure 2:
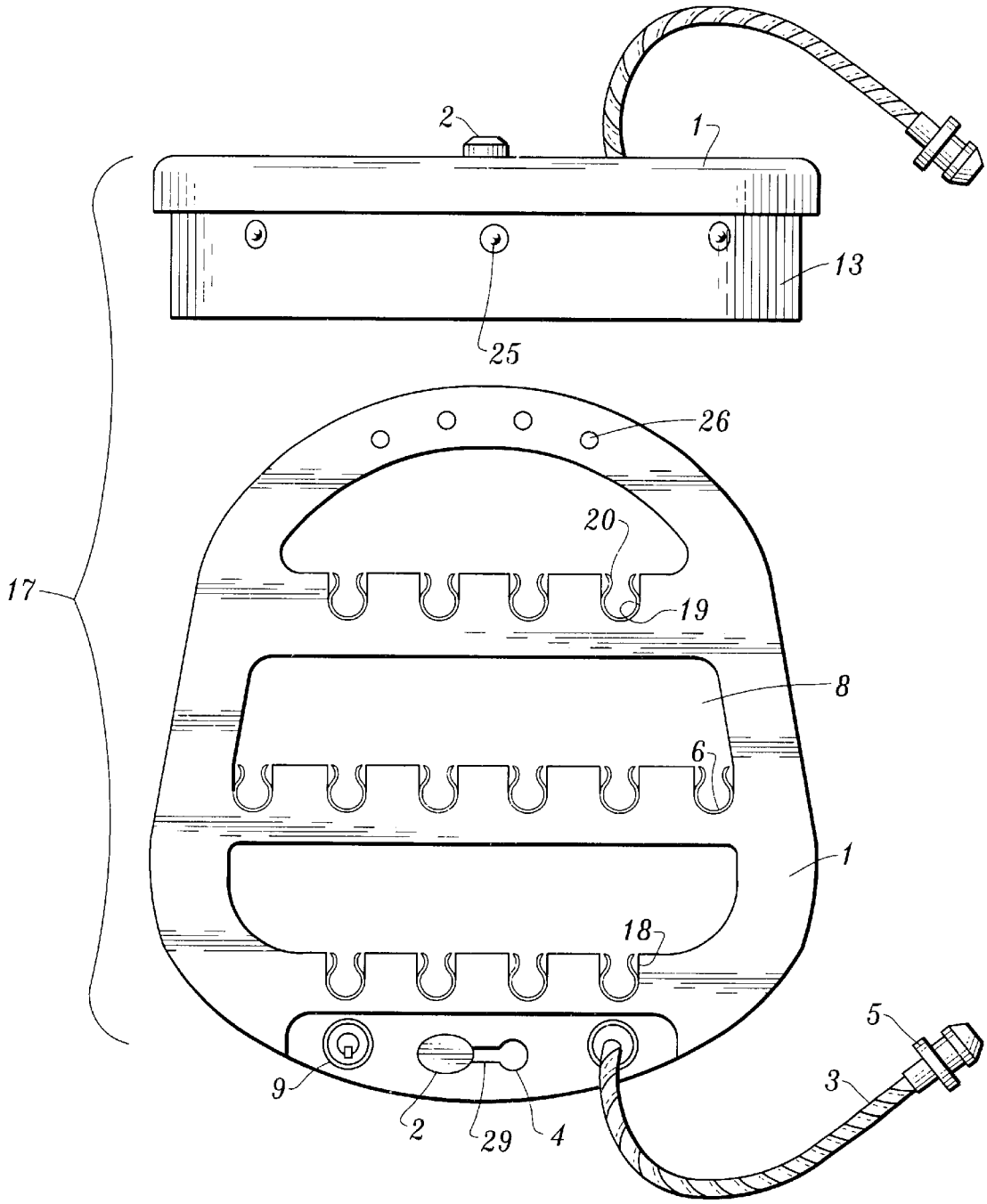
FIG. 2 is a top view and side view of such the integrated golf club lock assembly with slide latching lock, according to the invention.

In FIGS. 1–6 the integrated golf club lock and golf club bag 22 is shown according to preferred embodiments of the invention with golf bag 11 and locking assembly 17 integral therewith being positioned at top portion 21 of golf bag 11 as seen in FIG. 1. A substantially rectangular or trapezoidal upper housing 1 may be provided as seen if FIGS. 1, 2, 3, and 4, however, the concept is applicable to any shape or configuration chosen, such as circular, oval, triangular, square, odd-shaped, etc. The upper housing 1 is preferably attached to the top of the bag 21 by means of rivets 25 or other appropriate fastenening means as seen in FIGS. 1 and 2. The primary function of the upper housing 1 is to enclose the assembly 17 and provide structural rigidity. As seen in FIGS. 2, 3, 5, and 6 the upper housing 1 acts as a retainer for elastic bumper or bumpers 6, which may be configured either as a plurality of elastic holders projecting from the upper and lower housing elements, or be a single piece adapted and configured to fit into the lower housing, and locking plate 7, in effect sandwiching and holding these parts together. Bumper 6, may in alternative embodiments, be eliminated as a separate component and provided as an integral part of the lower housing. with the Upper housing 1 also contains guide tracks 28 as shown in FIGS. 3, 4, 5, and 6 which serve to hold, constrain and limit the motion of the locking plate within the device. Upper housing 1 also preferably contains club dividers 8, tee holders 26 and the ports or openings 18 for the golf clubs to be inserted in to and an anchor pin hole 4 for anchor pin 5. Although the clubs are retained by the elastic bumper 6, the upper housing 1 provides part of the structural integrity for these openings. In addition upper housing 1 also contains the key cylinder 9, slide latch 2 and cable locking assembly including components 3, 4, 5, and 16, although these features may be incorporated in other configurations of the invention. Housing 1 is preferably composed of a durable resilient material such as plastic, metal or rubber, but may be otherwise.

Figure 3:
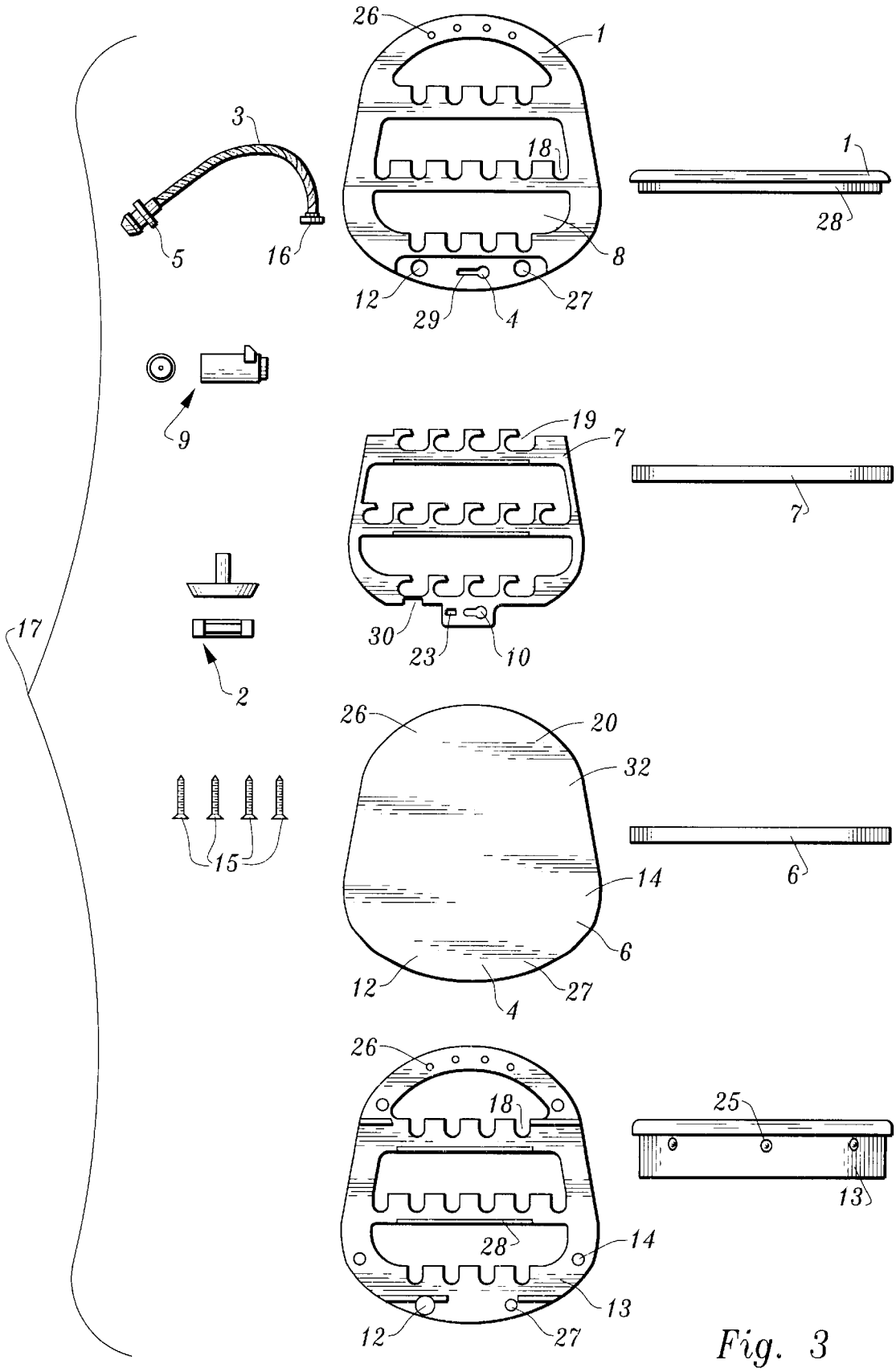
FIG. 3 is a top view and side view (exploded) of the assembled parts of such integrated golf club lock assembly, according to the invention.
Figure 4:
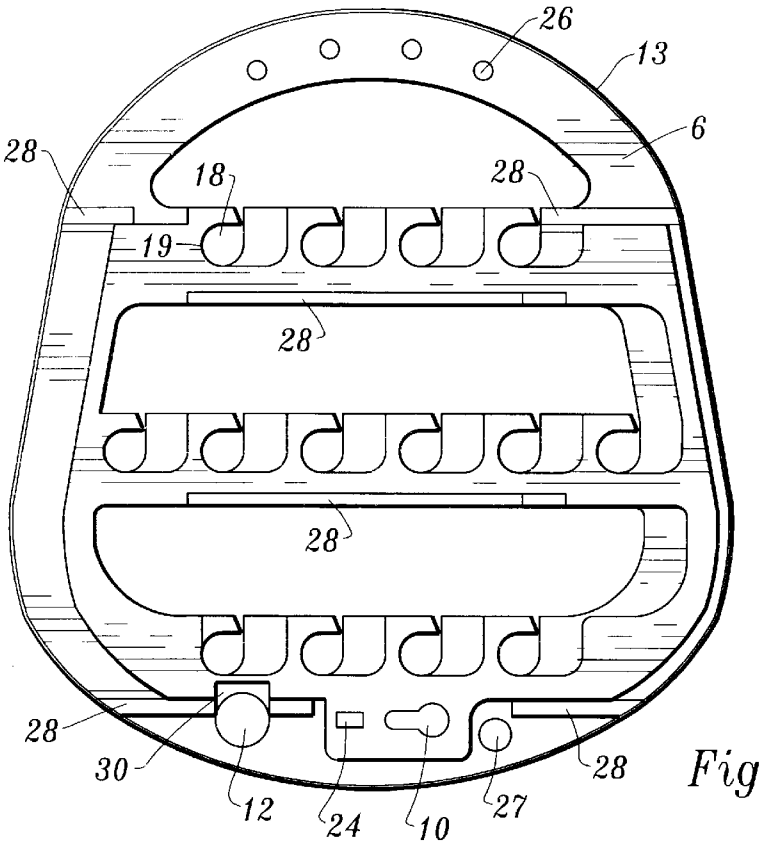
FIG. 4 is a top view of the assembly with the upper housing removed showing the operative function of the locking plate, according to the invention.

A lower housing 13, best seen in FIGS. 2, 3, and 4, is the bottom portion of the device which encloses and contains the elastic bumper 6 and locking plate 7. Lower housing 13 also contains guide tracks 28 as shown in FIGS. 3, 4, 5, and 6 which serve to hold, constrain and limit the motion of the locking plate within the device. The lower housing 13 with apertures 18 provides the lower half of the structure, which encloses the whole assembly 17. Retaining screws 15 are inserted through the lower housing 13 into the upper housing 1 which hold the entire assembly 17 together. Housing retainer screws preferably comprise four retainer screws 15 which sandwich all parts together and fasten the lower housing 13 to the upper housing 1 still allowing the locking plate to slide into the closed or open position.

A key cylinder 9, best seen in FIGS. 2 and 3 provides a locking mechanism that contains a paul 30 that is actuated by a key. When the key is rotated into the locked position the paul 30 is thrown which engages with the locking plate and prevents movement of the slide latch 2 in to the open position. There are detents in the interface between the slide latch 2 and the upper housing 1 such that when the slide latch 2 is either in a locked or unlocked position it is secured there by means of these detents.

Figure 5:
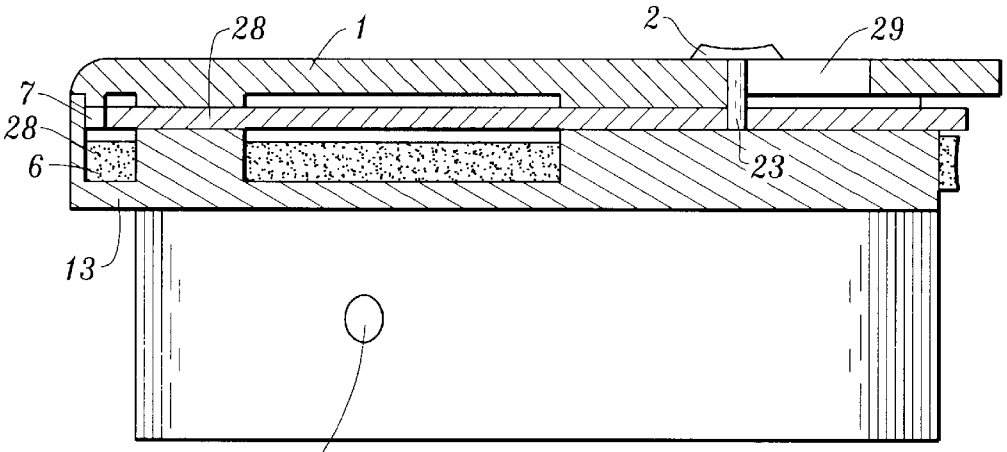
FIG. 5 is a horizontal section through the top view showing a cross-section of the assembly and the approximate configuration, relation and operation of the included parts, according to the invention.
Figure 6:
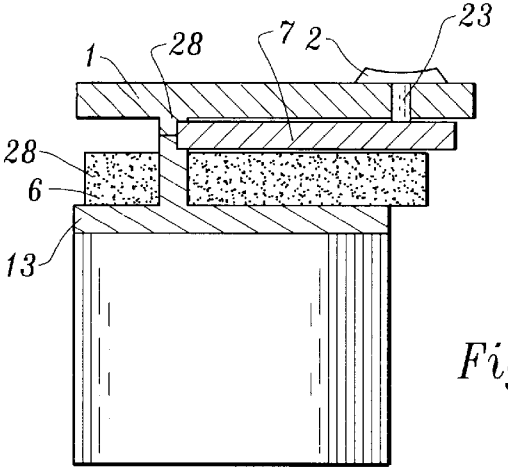
FIG. 6 is a vertical section through the top view showing a cross-section of the assembly and the approximate configuration, relation and operation of the included parts, according to the invention.

As seen in FIG. 4, a single locking plate 7 with ports or apertures 18 is the locking mechanism that preferably constrains the golf clubs within each of its port openings, fourteen in the preferred embodiment. Latch means, preferably a slide latch 2 as seen in FIGS. 2,3,5, and 6 is coupled to the locking plate by means of a coupler 23 which fits in to the locking plate slot 24, seen in FIGS. 3, and 4, and is guided by a slide latch track 29 that has detents which hold the slide latch 2 in either the open or locked position. In other embodiments, a dial knob latch or other closing mechanism may be substituted for the slide latch. The locking plate 7, is actuated by slide latch 2 which moves transversely across the individual golf club port openings closing these openings off and locking the golf clubs in place. As seen in FIGS. 4, 5, and 6 the locking plate 7 is fitted into a track 28 that is formed by the upper housing 1 and the lower housing 13, although other configurations may be possible. This track 28 contrains the locking plate within the locking assembly 17 and restricts and guides the movement of the locking plate 7 across the golf club ports 18. Each golf club port 18 is designed such that when the locking plate 7 is in the locked position it completes the circular opening and in effect shuts it off.

One port 10 of the locking plate 7 is preferably sized differently than the other ports and corresponds to aperture 4 in the upper housing. It contains a different dimension hole then the other ports in the locking plate 7. Aperture 4, in the upper housing 1, is not a port but an actual hole designed to accept an anchor pin 5 which is connected to a cable 3. Anchor 5 is designed such that when the pin is inserted in to the hole of the upper housing 4 and through the elastic bumper 6 and in to locking anchor port 10, it is locked in to the assembly 17 by means of a slot in the locking port 10 that narrows down the opening when the locking plate 7 is moved in to the locked position thereby locking the anchor pin 5 in to the assembly 17.

Elastic bumper 6, as seen in FIGS. 2, 3, 4, 5, and 6, has two principal functions. First, it constrains the golf clubs within the assembly 17 so that they are held in place prior to locking plate 7 being moved in to the locked position, and it protects the clubs from coming in contact with either the upper or lower housing 1, 13 or locking plate 7. This protection from contact with either the housing 1, 13 or the locking plate 7 is meant to guard each club from scratching or other abrasion that may occur from contact with these members. When each club is inserted into a port 18 of the lock the elastic bumper 6 is depressed that allows the clubs to snap and be held in place within each port 18. This snapping holds the clubs prior to being locked and provides a positive feel that each club is correctly in place. Elastic bumper 6 is designed to accept and retain the golf clubs. In addition, elastic bumper 6 has several holes 26, 14, 12, 4, 27 and slots 32 that are designed to mate with the corresponding holes and slots in the upper and lower housing 1 and 13, allowing those functional parts (tees, retaining screws 15, guide tracks 28, cable 3, key cylinder 9, anchor pin 5) to pass through the elastic bumper, although different configurations may exist. The material of this part could be any resilient material such as plastic and could be designed in different ways to accept and retain golf clubs.

Locking cable 3 is constrained within the assembly 17 by means of a cable anchor 16 as seen in FIG. 3, that is larger then the cable anchor holes 27 that are in the upper housing 1, elastic bumper 6 and lower housing 13, thereby constraining the cable 3 within the assembly. Cable anchor 16 and cable anchor pin 5 is preferably a hard material such as metal or plastic. Locking cable 3 is a cable with one end attached to the cable anchor 16 and the anchor pin 5 attached to the other end as seen in FIGS. 2,3. Anchor pin 5 is a pin configured to fit in to the upper housing 1 through the elastic bumper 6 and through the locking plate 7 through aperture 4. It is preferably held in place by means of snapping in to the rubber bumper 6. The loop which is created by placing the anchor pin 5 in the upper housing opening 4 is then locked in place when the locking plate 7 is moved in to the locked position. The initial diameter of the opening 10 for the anchor pin 5 is reduced when the locking plate 7 is moved in to the locked position thereby closing off or locking the anchor pin 5 into the housing 1 and 13.

In operation and use the integrated golf club lock and golf club bag of the present invention is a new way of providing club security and protection for golf clubs. The integrated golf club lock and golf club bag of the present invention provides docking stations or ports 18, 19, and 20 that each golf club can snap or insert in to. These individual docking stations hold the clubs by means of an bumper 6 that not only holds the clubs within the lock but also protects the shafts from any abrasion. Once the clubs have been inserted in to these docking stations then the simple movement of a slide latch moves a single locking plate 7 across the opening of these docking stations closing off the openings and locking the clubs within the device. Whereas prior golf club locks decrease the size of the openings that the clubs fit in to and squeeze the clubs in a locked position, the present invention maintains the size of the individual opening and merely shuts it off. This allows for the use of assembly 17 as both a golf club bag lock for security purposes of as a golf club holder/organizer and positioning device within a golf bag when the device is not locked.

The rectangular or trapezoidal design of assembly 17 is unique in that it is similar to most of the slot patterns that are used by golf bags today and yet provides the additional functions of locking and organizing. This design allows for a traditional club configuration and thereby a convenient hand held "easy on / easy off" type of lock that can be used in conjunction with most current styles of golf club bags. In addition, the size and weight of the integrated golf club lock and golf club bag is such that it can be easily carried as part of the bag, used as an organizer, and used only on an "as needed" basis.

Cable lock 3, cable anchor 16, and anchor pin 5 provide a simple, effective means of attaching the lock/clubs system to any convenient location. The locking means does not require additional locking apparatus and is part of and incorporated into the locking feature of assembly 17.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A golf club locking device in combination with a golf club bag, comprising:

a golf club bag;

a locking plate;

a key cylinder;

an upper housing element having an upper track means projecting therefrom for guiding a locking plate secured within golf club locking device;

a lower housing element, said lower housing element having a lower track means projecting therefrom and configured so that said locking plate moves on said lower track means and on said upper track means;

latch means for securing said locking plate, said latch means being operably coupled to said upper housing element so that when said latch means is moved in an aperture in said upper housing element said locking plate is moved, the locking plate being adapted and positioned to move on said upper track means projecting from said upper housing element and on said lower track means projecting from said lower housing element, said locking plate being able to move freely between said upper and a lower housing elements so that when said locking plate is moved golf clubs secured within a plurality of ports of said locking plate are secured therein by said key cylinder, said key cylinder being communicatively linked to said locking plate through a second aperture in said upper housing;

bumper means for holding golf clubs within said golf club bag, said bumper means being secured to said lower housing element; and cable locking means mounted in a third aperture of said upper housing for locking said golf club locking device to an object.

2. The golf club locking device of claim 1, wherein said cable locking means comprise a cable and a cable anchor pin.

3. The golf club locking device of claim 1, wherein said latch means is a slide latch operably secured in a retaining aperture of said golf bag.

4. The golf club locking device of claim 1, wherein said locking plate includes a plurality of apertures sized to receive and secure golf clubs.

5. The golf club locking device of claim 1, wherein said bumper means is a rubber or plastic bumper having a plurality of ports sized to receive and secure golf clubs.

6. The golf club locking device of claim 1, wherein said bumper means is a plurality of rubber or plastic projections extending from said lower housing element.

* * * * *